US005653080A

United States Patent [19]

Bergeron

[11] Patent Number: 5,653,080

[45] Date of Patent: Aug. 5, 1997

[54] FABRICATED WOODEN BEAM WITH MULTIPLE WEB MEMBERS

[76] Inventor: Ronald Bergeron, 260, Rue De la Station, C.P. 40, Laurier-Station (Québec), Canada, G0S 1N0

[21] Appl. No.: 547,573

[22] Filed: Oct. 24, 1995

[51] Int. Cl.[6] ..... E04C 3/14

[52] U.S. Cl. ..... 52/729.4; 52/730.7; 52/731.3; 52/732.2

[58] Field of Search ..... 52/724.1, 724.5, 52/729.4, 730.4, 730.1, 730.7, 731.1, 731.3, 731.4, 690, 692, 729.2, 731.2, 732.1, 737.6, 696

[56] References Cited

U.S. PATENT DOCUMENTS

| | | | |
|---|---|---|---|
| 2,125,690 | 8/1938 | Ragsdale et al. | 52/731.2 |
| 4,195,462 | 4/1980 | Keller et al. | 52/690 |
| 4,241,133 | 12/1980 | Lund et al. . | |
| 4,413,459 | 11/1983 | Lambuth | 52/729.4 |
| 4,843,777 | 7/1989 | Shimabakuro | 52/730.7 X |
| 4,967,534 | 11/1990 | Lines . | |

FOREIGN PATENT DOCUMENTS

| | | | |
|---|---|---|---|
| 1067272 | 12/1979 | Canada . | |
| 1279972 | 2/1991 | Canada . | |
| 2691993 | 12/1993 | France | 52/729.4 |
| 1484978 | 5/1969 | Germany | 52/731.2 |
| 3423751 | 1/1986 | Germany | 52/729.4 |
| 120991 | 12/1918 | United Kingdom | 52/731.2 |
| 978639 | 12/1964 | United Kingdom | 52/729.2 |
| 1367893 | 9/1974 | United Kingdom | 52/729.4 |

*Primary Examiner*—Michael Safavi

[57] ABSTRACT

This invention relates to a wooden beam built up of two chord members separated by two web members forming a rectangle with the chord members. The chord and web members may be made of solid wood, Oriented Strand Board (OSB) Laminated Veneer Lumber (LVL), Waferboard or Veneer. The wooden beam is made of upper and lower chord members and two planar web members all interconnected by means of mechanical and adhesive secured joints. The overall outline of the section shape of the fabricated wooden beam is similar to standard lumber and can be made to fit the same standard dimensions available on the market or any other dimension, allowing for easy assembly with existing apparels and equipment. Chord members are extended by a finger jointing method; longitudinally extending grooves are provided on each side of a chord member, near an edge. Web members have their ends provided with a tongue shaped as to substantially fit in the chord members grooves.

4 Claims, 2 Drawing Sheets

FABRICATED WOODEN BEAM WITH MULTIPLE WEB MEMBERS

TECHNICAL FIELD

This invention relates generally to lumber utilized in construction and to derivatives of the forestry industry. It also relates to more specific construction elements such as joists, girders, rafters and trusses.

PRIOR ART

The traditional wood beam was made in one piece cut from large trees in appropriate size and length. That required a population of large trees in which the lumber would be cut, and the quality and strength would largely vary in function of the quality of the trees.

Through the years longer and stronger beams have been required and the available trees have decreased in population and size. The costs of sawn lumber has raised and high quality wood required for large beams has become scarce. Many solutions have been brought up over the years to make beams with smaller trees or other less expensive and more available wood products keeping in mind the need for higher requirements on the market. Fabricated beams allow for a more efficient design in the utilization of raw materials for a given strength beam. It saves wood, reduces transportation cost and facilitates the erection of wooden structures.

In construction, joists, rafters, girders and trusses generally support loads applied in one direction, thus allowing for a fabricated beam design that would support compressive and tension loads generated in its chord members by such a load. It is seen that two or more joists would be installed side by side to give stronger support to a structure at a given point. It is then more desirable to have a rectangular section shaped beam, to keep the proximity of the two beams to a minimum and facilitate their binding to one another. The present invention relates to both principles of compression and tension in the chord members and while providing a rectangular section for ease of installation side by side. Wooden beams and wooden I-beams of this general type are disclosed more extensively in the following patents:

U.S. Pat. No. 4,967,534 Lines, 1990 Nov. 06. Chord members are rectangular and horizontal, with a single groove made in larger side of the rectangular section; a web is provided with a necked down end to be matched by a matching design in the groove. The web may be made of stratified wood.

U.S. Pat. No. 4,195,462 Keller, 1980 Apr. 01. A web may be made of glued particles of wood and having four shaped ends interlocking in a chord.

U.S. Pat. No. 4,241,133 Lund, 1980 Dec. 23. A composite wood material is used to form I beams with flakes having a grain direction parallel to a longitudinal axis with length to width ratio of 4:1 to 10:1.

CA 1,067,272 Casselbrant, 1979, Dec. 04, illustrates a beam made according to a glued wood chip fabricating method.

CA 1,279,972 Lines, 1991, Feb. 12, refers to the same system as U.S. Pat. No. 4,967,534 above.

These patents are listed as examples only.

More should be said on the effect of weather on some types of wooden materials for example: solid webs may be made of wood chips, which are cheap but not suitable for situations where no protection against weather exists. I am mainly concerned with materials utilized in construction and having some protection against direct weather effects. A high degree of shape stability had to be attained, such as for the acceptance of a pinpoint load at any position along a beam, The generally high cost of manufacturing had to be lowered.

Improvements came with the arrival of a several wood layer web into which adjacent layer fibers are perpendicular in direction and the web is connected over its entire length by a tongued connection into a chord member made of whole timber. The arrival on the market of particulate panels has been beneficial to the industry and a common method of jointing comprises a tongue particulate web into a chord. Other attempts were made to improve the idea, such as wooden webs made of oriented fibers connected to a high quality wood chord member, making the product more expensive but not necessarily more technically advanced. With today's technologies it has been possible to put together a structural beam that will have good shape stability and higher bending resistance. It is desired in the following lines to describe a new type of fabricated beam structure that improves the stability and strength and that can be manufactured at low cost.

OBJECTS OF THE INVENTION

It is a primary object of the present invention to provide a fabricated wooden beam with the properties and advantages of a fabricated wooden I beam but with similar dimensions as a standard lumber beam utilized for joist, girder, rafter and truss, thus not requiring any different assembly technique and/or dimensioning requirement.

One of the principal objects of the present invention is to provide a wooden fabricated beam constructed from smaller lumber and other derivative wood products such as Oriented Strand Board (OSB) and Laminated Veneer Lumber (LVL) allowing for simplicity of fabricated wooden beam structure and low manufacturing cost.

It is another object of the present invention to provide a joint between web members and chord members which permits use of a standard adhesive accepted by the different regulating agencies.

It is another object of the present invention to provide a better load transfer from an upper chord member to a lower chord member through a multiple web design assembly, thus reducing any loss of strength caused by the elasticity of web member fibers.

It is another object of the present invention to provide a fabricated wooden beam which may be produced in a continuous or non-continuous assembly process and maintain high strength consistency.

It is still another object of the present invention to provide a wooden beam manufactured as joists, which may be utilized in diverse design configurations to complete a wide variety of structural applications.

SUMMARY OF THE INVENTION

In the present invention the fabricated wooden beam is made of two chord members and two web members, the chord members being made of solid wood or Laminated Veneer Lumber (LVL) and the web members from Oriented Strand Board (OSB) or Wafer Board or Veneer. The upper and lower chord members and the two planar web members are all interconnected by means of mechanical and adhesive secured joints. The overall shape of the assembly is similar to standard wood boards on the market allowing for easy assembly with existing apparels and equipment on the market. Chord members are provided with two longitudinally extending grooves, one on each side near the edge of the chord. Both web members have their edges shaped as to substantially fit in the chord members' grooves. The final assembly has a generally rectangular outside section matching the dimensions of standard lumber or any other dimensions.

The present invention will be better understood and additional advantages will become apparent from the following detailed description.

DESCRIPTION OF THE INVENTION

The invention is explained in the following text in reference to a preferred embodiment which is shown here, in the accompanying drawings.

DRAWINGS

DETAILED DESCRIPTION

Figure 1A:
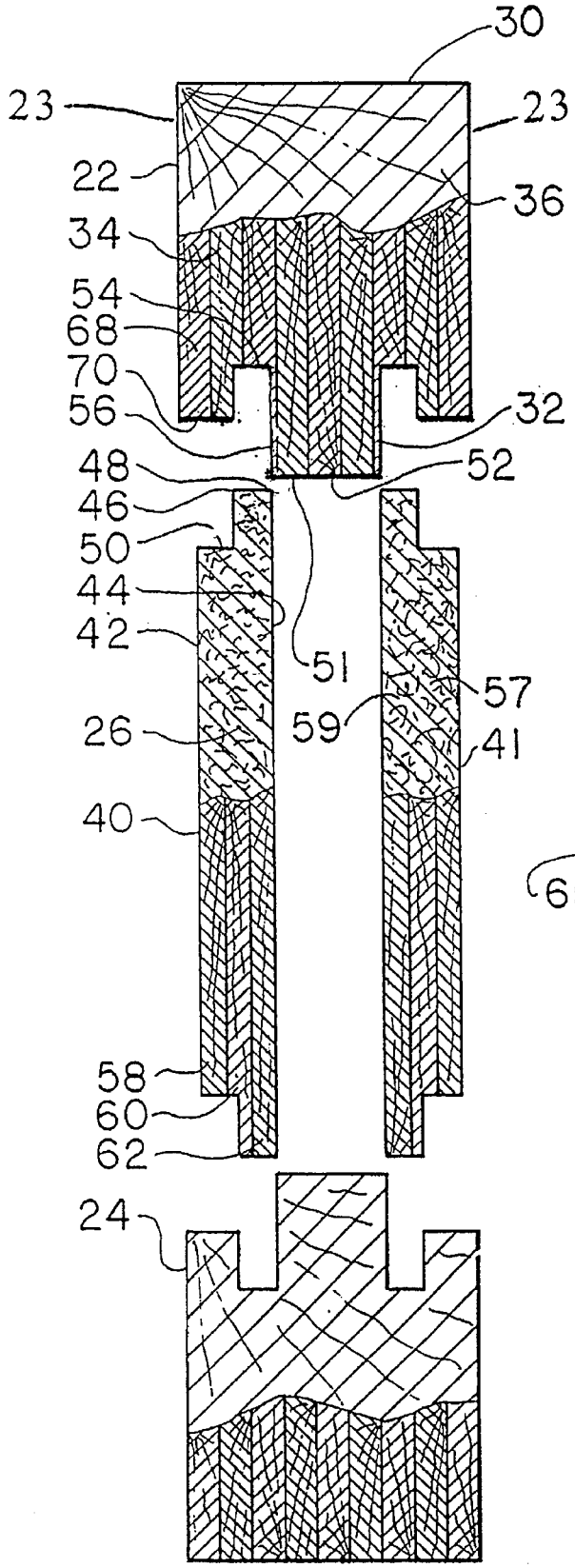
FIG. 1A Shows a preferred embodiment in cross section before jointing.

Referring to the preferred embodiment drawings there is shown in FIG. 1A a wooden beam 20, fabricated from a pair of chord members namely an upper chord 22 and a lower chord 24 and a pair of web members 26; the chord members 22 and 24 may be made of solid wood or Laminated Veneer Lumber (LVL) and web members 26 made of Oriented Strand Board (OSB) or wafer board and veneer. The upper chord member 22 has an exterior face 30, two parallel sides 23, and an interior face 32, having a chord member centre tenon 51 and a longitudinal groove 54 in each corner of the interior face 32.

As shown in FIG. 1A each chord member contains two longitudinal groove sites 70 having one entrance portion to chord member groove 54 and one shoulder portion 68. The web members 26 have a tongue 46 thickness equal to the chord member grooves 54 width, and a web shoulder 50 width slightly smaller than the chord member shoulder portion 68 width to allow for some expansion of the web material towards the outside of the wooden beam. Strict tolerances on web tongue 46 thickness and chord member groove 54 width act as a self-locking type joint when the web tongue 46 is forced into the chord member groove 54. To complete the joint between the web members 26 and the chord members 22 and 24 all the surface in contact between these members are coated with a suitable adhesive 64 before being forced into each other and held until the adhesive 64 has sufficiently cured in place.

As shown in FIG. 2 many types of web tongues 46 or chord member groove 54 fit shapes could be utilized to achieve web member 26 to chord member 22 and 24 jointing, as long as the type of joint would give good transfer of force for bending stiffness and moment capacity and help maintain the web members 26 into the chord members 22 and 24 during an adhesive curing period when required in the process. It is important to note that the thickness of the web member tongue 46 is approximately 5/16", that is many times the thickness of the flakes making the OSB, thus allowing for sufficient strength in the joint when OSB is utilized.

Chord members 22 and 24 are finger jointed when their length is insufficient to cover the whole beam length. The wood and the adhesive 64, are heated to recommended temperature, then two finger joints are forced into each other and kept under pressure until the adhesive 64 has properly cured. The web members 26 are finger jointed with a similar process such as with an tongue end for meeting a groove but their faces and the adhesive 64 are not heated.

In general practice the assembly chord members are made of solid wood lumber of a standard dimension and the assembly is put together to fit the industry standard dimension or any other dimension as represented by dimension line 65. The control of the industry standard dimension line 65 is achieved by the control of web member shoulder 50 dimension and by the assembly of the web 26 to the chords 22 and 24. Thus the present structural fabricated beam may substitute for a solid wood dimension lumber without making any changes or adjustments in the dimensions called for on the construction plans, in thickness, width and length. The web members 26 are generally made of Oriented Strand Board (OSB) or Wafer Board or Veneer. The chord members 22 and 24 are generally made of solid wood or Laminated Veneer Lumber (LVL). Chord members comprise an upper chord 22 which when working, operates in compression, and a lower chord 24 which normally operates in tension. It is not essential that the two chord members be identical in height, but they are generally so to permit utilization in reverse, the upper chord being the lower chord and vice versa.

ADVANTAGES

The double web members 26 (or multiple webs) design provide for a better shape stability, a better load resistance parallel to the webs' planes and a better torsion resistance around the longitudinal axis of the fabricated beam, than a similar size standard lumber. The transfer of load forces is more uniform between the two chord members, by having the webs parallel and towards the outside of the fabricated beam. They transfer any reaction force more uniformly into the chord members fibers ensuring a better utilization of all the fiber of the chord members section area, thus diminishing any loss of compression or tension trough wood elasticity. Some secondary advantages are similar stocking volume as for standard lumber beam and better fire retardant than one web design.

The present invention is environmentally efficient by using smaller trees and wood industry by-products, technically efficient by providing a consistent high strength beam for load carrying capacity and economically efficient by allowing for mass production thus lowering manufacturing cost.

A test on a 2"×12" double web[s] beam of this present invention design with solid wood chord members (2"×4" MSR-Machine Stress Rated) and OSB webs (5/8" thick) has given similar moment capacity and has attained 70% of bending stiffness of a 3"×14" trust joint LVL/Plywood I-Joist beam, per ASTM D 198 Standard flexure test. Actual webs on 2"×12" double webs are 3/8" thick. The chords are easy to transport. The webs are transported separately. The webs may be different and vary from 4" to 30". The webs are assembled only at the point of fabrication before use. There is no need to use press fit, only glue. The webs may be made of various materials. The central part may be insulated by Thermofoil™ or be lined by fire retardant materials.

CONSTRUCTION OF A TYPICAL BEAM

A fabricated wooden beam has a generally rectangular outline section, comprising a pair of chord members and a pair of planar web members interconnecting the chord members by means of fitting adhesive secured mechanical joints between chord members and opposed edges of the parallel web members, the joints comprising two longitudinal grooves in the chord members edges' corners, receiving adhesive and one edge of a web member in each groove, the grooves having cross sections shaped to provide a matching fit of the web members edge, providing upon mating a substantially close fit to maintain a final cured assembly high shape stability and force transfer between the two chord members and helping adhesive properly cure without change in assembly dimension therefor.

The chord members can be made of solid wood 36 or Laminated Veneer 34 Lumber (LVL) and web members from Oriented Strand Board 57 (OSB) or Wafer Board 59 or Veneer 58, which may utilize a second stratum 60, a third stratum 62 or more. The shape of the joints between the chord members and the web members is such as is normally acceptable in a manufacturing process according to the adhesive utilized, in a continuous or non-continuous process, while maintaining high consistency. The fabricated wooden beam may be used as joists, rafters, trusses and girders, utilized in diverse design configurations, to complete a wide variety of structural applications. The fabricated beam may have more than two web members.

Figure 1B:
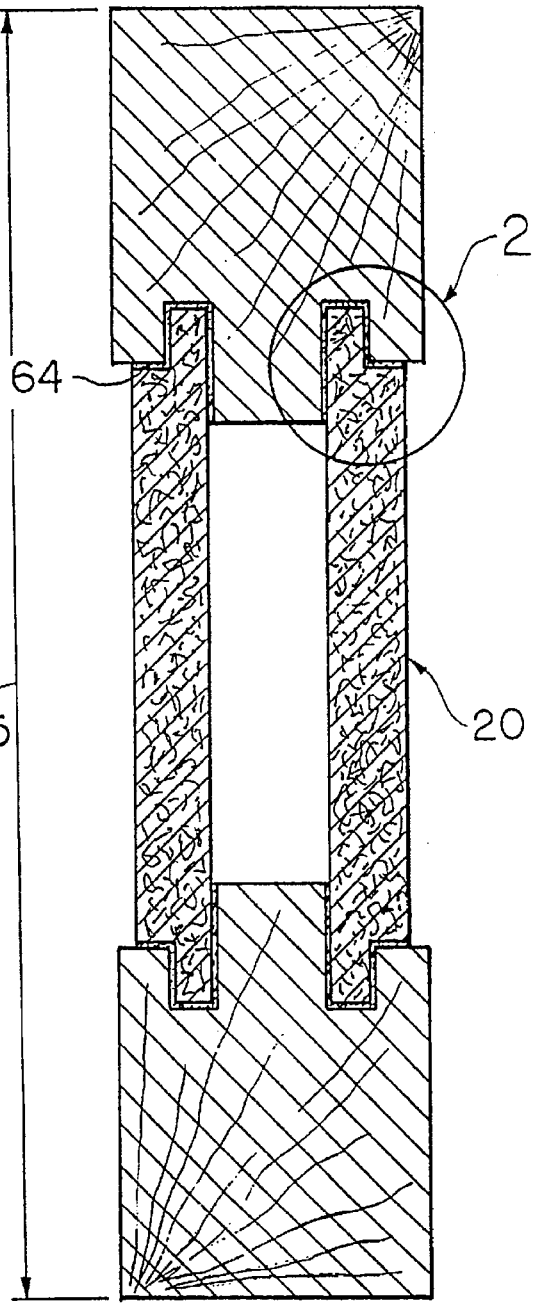
FIG. 1B Shows the embodiment of FIG. 1A after jointing.

A general description entails a fabricated wooden beam 20 (FIG. 1B) with multiple web members comprising:

an upper chord 22 FIG. 1A, a lower chord 24 and two elongated web members 26, the upper chord 22 being quadrangular and comprising an exterior face 30, an interior face 32 and two parallel sides, a left web 40 comprising an external face 42 and an internal face 44, a mating end 48 joining the internal face 44 to the external face 42, the mating end 48 comprising a tongue 46, the left web 40 being left handed and working in cooperation with a similar right web 41 being right handed, the interior face 32 comprising a tenon 51 located centrally with respect to the parallel sides and two opposed sites less prominent than the tenon and each carrying a groove 54, the tenon 51 comprising an extremity 52 and two opposed faces 56, the internal face 44 at the mating end 48 being placed against the opposed face 56 and the tongue 46 being in the groove 54 acting in combination with adhesive means 64 causing the permanent joining of the fabricated wooden beam 20.

Figure 2B:
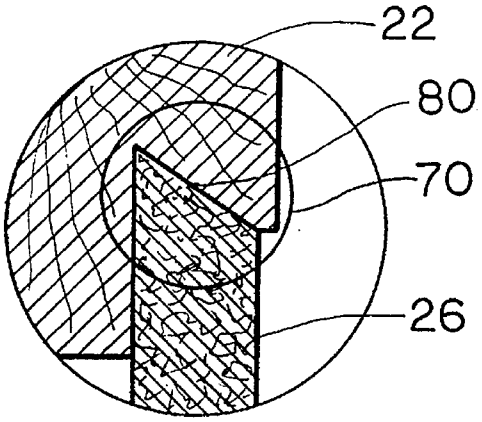
FIG. 2B Shows an alternative to FIG. 2A.
Figure 2C:
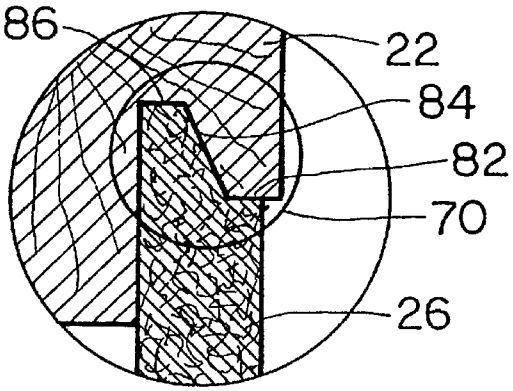
FIG. 2C Shows an alternative to FIG. 2B.
Figure 2E:
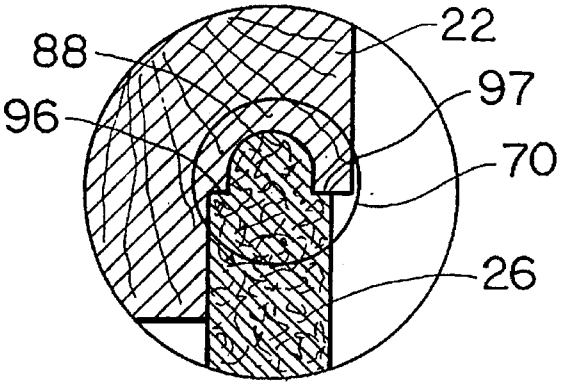
FIG. 2E Shows an alternative to FIG. 2D.
Figure 2A:
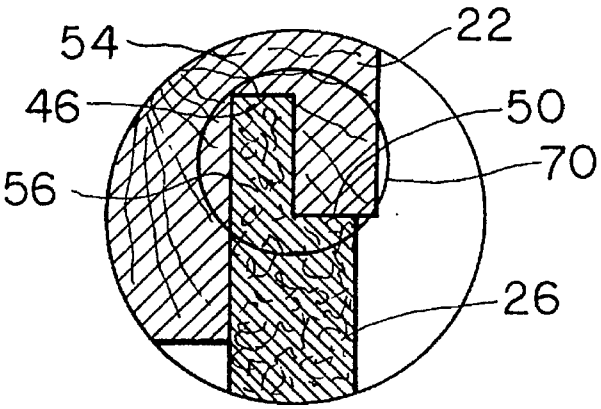
FIG. 2A Shows the area of arrow 2 of FIG. 1B.
Figure 2D:
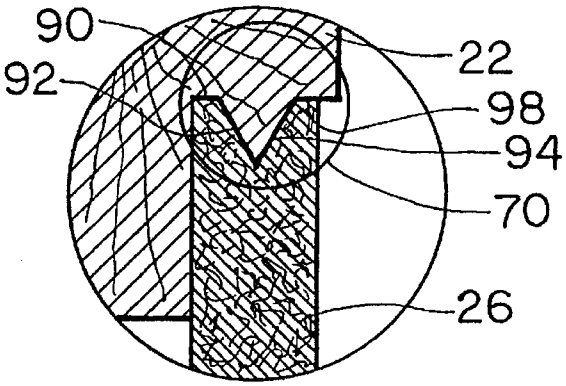
FIG. 2D Shows an alternative to FIG. 2C.

Each groove 54 forms a rectangle located at or near one of the opposed faces 56, the rectangle being suitable to receive the tongue 46 as shown in FIG. 2A. In another version, the groove (FIG. 2B) forms an acute angle 80. The groove in FIG. 2C forms a trapezium shape 84 with a far contact end 86 and extending to a shoulder contact face 82 adapted to contact a web shoulder 50. The groove in FIG. 2D defines a short trapeze 92 having a small end 90 acting as a far contact, the short trapeze 92 being replicated by a mirror image trapeze leaving an angular recess 94 and having a small end 98 near a side of the chord both short trapezes protruding from the right web.

The groove in FIG. 2E comprises a half circle 88 with two shoulders, a near shoulder 96 located near the tenon and an exterior shoulder 97 on an opposite side of the half circle and coinciding with a side of the chord, the half circle forming a wrapping for a protruding mating end of the web. The mating end may be provided with a recess adapted to receive a stuffing material to fill the recess and the half circle to cause intimate contact between the web and the chord. The orientation of the grooves in FIG. 2E and 2D may be inverted.

The embodiment of the invention herein illustrated presents a preferred form and composition thereof and should not be construed as limiting. The drawings described herein illustrate a very small sample of some of the possible designs. From the above description it will be apparent that there is thus provided a device of the character described which possesses the particular features and advantages enumerated as desirable, rendering the invention susceptible of modification in its proportions, form, detail construction and arrangement of parts without deviating from the principle involved, or sacrificing any of its advantages, or modes of putting the invention into effect in any assembly, and not limitative. Furthermore any failure to describe such aspect is not intended to create any limitation to the present invention. Any other aspects, advantages and modifications within the scope of the invention will be apparent to those skilled in the art to which the invention pertains. Thus the scope of the invention should be determined by the appended claims and their legal equivalents, rather than by the examples given.

| PARTS LIST | |
|---|---|
| 20 | wooden hollow beam |
| 22 | upper chord |
| 23 | parallel sides |
| 24 | lower chord |
| 26 | web member |
| 30 | exterior face |
| 32 | interior face |
| 34 | laminated veneer |
| 36 | solid wood |
| 40 | left web |
| 41 | right web |
| 42 | external face |
| 44 | internal face |
| 46 | tongue |
| 48 | mating end |
| 50 | web shoulder |
| 51 | tenon |
| 52 | extremity |
| 54 | groove |
| 56 | opposed faces |
| 57 | oriented strand board |
| 58 | veneer |
| 59 | waferboard |
| 60 | second stratum |
| 62 | third stratum |
| 64 | adhesive means |
| 65 | dimension line |
| 68 | shoulder portion |
| 70 | sites |
| 80 | acute angle |
| 82 | shoulder contact face |
| 84 | trapezium shape |
| 86 | far contact end |
| 88 | half circle |
| 90 | small far end |
| 92 | short trapeze |
| 94 | angular recess |
| 96 | near shoulder |
| 97 | exterior shoulder |
| 98 | small end |

I claim:

1. A fabricated wooden hollow beam of a generally rectangular cross section for use in structural applications, said fabricated wooden hollow beam comprising:

a pair of chord members each having an interior face (32) comprising two edge corners, a raised central part defining a rectangular tenon (51), two longitudinal grooves (54) adjacent to said rectangular tenon (51) and two intermediate sites (70) located between said longitudinal grooves (54) and said edge corners, said rectangular tenons having two opposed faces (56) having a length and extending into said longitudinal grooves (54), forming an integral part thereof, each longitudinal groove having a depth and a width, said length of said opposed faces being equivalent to twice the depth of said longitudinal grooves, a pair of planar web members having an external face (42), an internal face (44) and opposed edges for interconnecting said chord members, each one of said opposed edges comprising a tongue (46) terminated by a mating end (48) and located near an end of said internal face (44), said opposed edges also comprising a web shoulder (50) located between said tongue (46) and a corresponding end of said external face (42), said longitudinal grooves receiving said web members opposed edges, and held together by a thin film of adhesive (64), wherein the abutting of said internal face (44) against said opposed faces (56) of said tenon (51), the insertion of said mating end (48) into said grooves (54) and the abutting of said web shoulder (50) against said site (70) coupled with the presence of a thin film of said adhesive (64) onto said matching fit, causing the firm jointing of said fabricated wooden hollow beam.

2. A fabricated wooden hollow beam (20) comprising:

an upper chord (22), a lower chord (24) and two elongated web members (26), said upper chord (22) being quadrangular and comprising an exterior face (30), an interior face (32) and two parallel sides (23), a left web (40) comprising an external face (42) and an internal face (44), a web shoulder (50), a mating end (48) joining said internal face (44) to said external face (42), said mating end (48) comprising a tongue (46), said left web (40) being left handed and used together with a right web (41), identical to said left web, and being right handed, said interior face (32) comprising a prominent tenon (51) located centrally with respect to said parallel sides (23) and two left and right sites (70) less prominent than said tenon (51) and located away from said tenon and near said parallel sides (23), said interior face (32) carrying a pair of grooves (54) localized between said tenon (51) and said sites (70), said tenon (51) comprising an extremity (52) and two opposed faces (56), each of said grooves (54) forming an open rectangle located at or near one of said opposed faces (56), said rectangle being suitable to receive said tongue (46), one first long side of said rectangle coinciding with said opposed face (56) and a second long side being reduced to a depth corresponding with a site (70) of said interior face (32) and wherein said first long side is twice the height of said second long side, said internal face (44) at said mating end (48) being placed against said opposed face (56) and said tongue (46) being in said groove (54) acting in combination with adhesive means (64) thereby causing the permanent jointing of said fabricated wooden hollow beam (20).

3. The hollow beam of claim 2, wherein said second long side is at an angle so that said open rectangle has a trapezium shape (84) comprising a far contact end (86) and a shoulder contact face (82) adapted to contact said web shoulder (50) at said sites (70).

4. A fabricated wooden hollow beam (20) comprising:

an upper chord (22), a lower chord (24) and two elongated web members (26), said upper chord (22) being quadrangular and comprising an exterior face (30), an interior face (32) and two parallel sides (23), a left web (40) comprising an external face (42) and an internal face (44), a mating end (48) joining said internal face (44) to said external face (42), said mating end (48) comprising a tongue (46) located next to said internal face (44) and a web shoulder (50) located next to said external face (42), said left web (40) being left handed and used together with a right web (41), similar to said left web and being right handed, said interior face (32) comprising a prominent tenon (51) located centrally with respect to said parallel sides (23) and two left and right sites (70) less prominent than said tenon (51) and located away from said tenon and near said parallel sides (23), said interior face (32) carrying a groove (54), said tenon (51) comprising an extremity (52) and two opposed faces (56) each opposed face having a length, said internal face (44) at said mating end (48) being placed against said opposed face (56) and said tongue (46) being in said groove (54) acting in combination with adhesive means (64) causing the permanent joining of said fabricated wooden hollow beam (20), said groove forming a half circle (88) with two shoulders, a near shoulder (96) located near said tenon and an exterior shoulder (97) on an opposite side of said half circle and coinciding with a parallel side (23) of said chord (22,24), said half circle (88) wrapping a protruding mating end (48) of said web, a diameter of said half circle being half of said length of said opposed face (56).

* * * * *